United States Patent [19]

Dekker

[11] Patent Number: 5,067,701

[45] Date of Patent: Nov. 26, 1991

[54] MULTIPLE BILL ESCROW MECHANISM

[75] Inventor: Donald A. Dekker, Grand Rapids, Mich.

[73] Assignee: Rowe International, Inc., Whippany, N.J.

[21] Appl. No.: 509,900

[22] Filed: Apr. 16, 1990

[51] Int. Cl.[5] ..... B65H 5/22

[52] U.S. Cl. ..... 271/7; 271/225; 271/274; 271/303

[58] Field of Search ..... 271/7, 69, 184, 225, 271/274, 298, 301, 302, 303, 273, 272; 209/534

[56] References Cited

U.S. PATENT DOCUMENTS 4,397,455 8/1983 Hickey ..... 271/3.1
4,722,519 2/1988 Zouzoulas ..... 271/274 X
4,747,493 5/1988 Nakanishi ..... 271/273
4,936,564 6/1990 Hain ..... 271/274 X

*Primary Examiner*—David H. Bollinger
*Attorney, Agent, or Firm*—Shenier & O'Connor

[57] ABSTRACT

A multiple bill escrow apparatus for forming a stack of successively received bills at an escrow location and for selectively moving the stack to a stacker or to a return in which a ram moves successively received bills to between pairs of first and second belt lengths to form the stack and in which the first and second belt lengths are mounted for relative movement to accomodate said stack and are concomitantly driven to move said stack out of the escrow position. Diverter belts are actuated selectively to direct the stack to a return path formed by pairs of third and fourth belt lengths mounted for relative movement to accommodate the stack and concomitantly driven to return the stack.

16 Claims, 3 Drawing Sheets

MULTIPLE BILL ESCROW MECHANISM

BACKGROUND OF THE INVENTION

There are known in the prior art bill acceptors which receive and test for genuineness bills deposited in a merchandising machine or the like. If the bill fails the test for genuineness it is returned to the customer. If the bill is acceptable, it may be sent to an escrow station whereat it remains until a purchase is complete. When the purchase is complete the bill is sent to a stacking mechanism. If, on the other hand, the customer changes his mind before the purchase is complete, he may press the return button and the bill will be returned.

The devices of the type described hereinabove function satisfactorily for individual bills. However, with the increasing price of articles being sold in merchandising machines and inflation, the cost of articles has been such that more than a single bill may be required to aggregate at least the purchase price of an article. The bill acceptors and the like of the prior art are not adapted to handle more than a single bill.

SUMMARY OF THE INVENTION

One object of my invention is to provide a multiple bill escrow mechanism which is capable of receiving and holding in escrow more than a single bill.

Another object of my invention is to provide a multiple bill escrow system which is relatively simple in operation.

A further object of my invention is to provide a multiple bill escrow mechanism which is certain in operation.

Still another object of my invention is to provide a multiple bill escrow mechanism which can deliver a multiplicity of bills from an escrow location either to a stacker or back to the customer.

Other and further objects of my invention will appear from the following description.

BRIEF DESCRIPTION OF THE DRAWINGS

In the accompanying drawings to which reference is made in the instant specification and which are to be read in conjunction therewith and in which like reference characters indicate like parts in the various views.

DESCRIPTION OF THE PREFERRED EMBODIMENT

Figure 1:
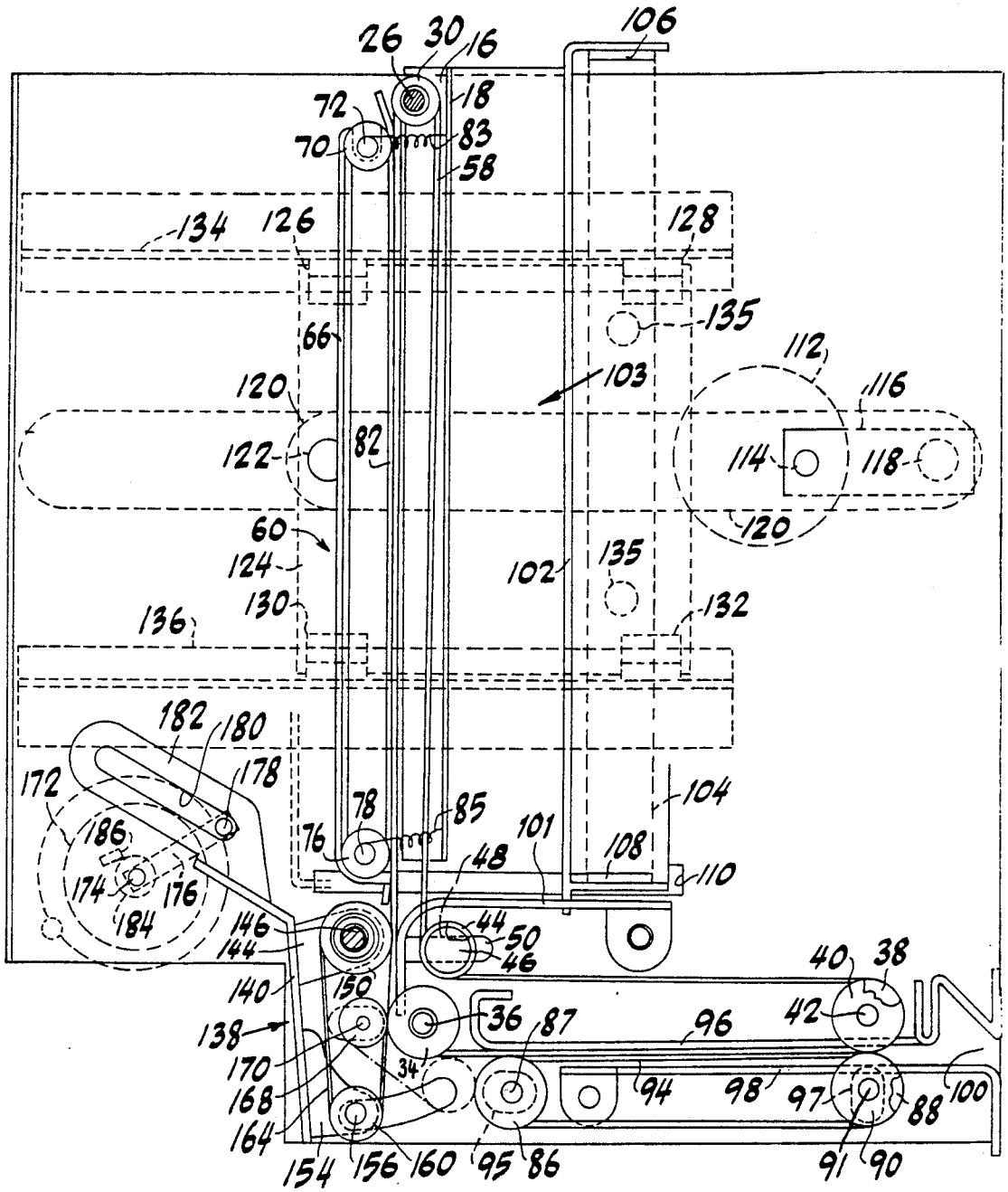
FIG. 1 is a side elevation of my multiple bill escrow mechanism with parts removed and with other parts shown in section.
Figure 2:
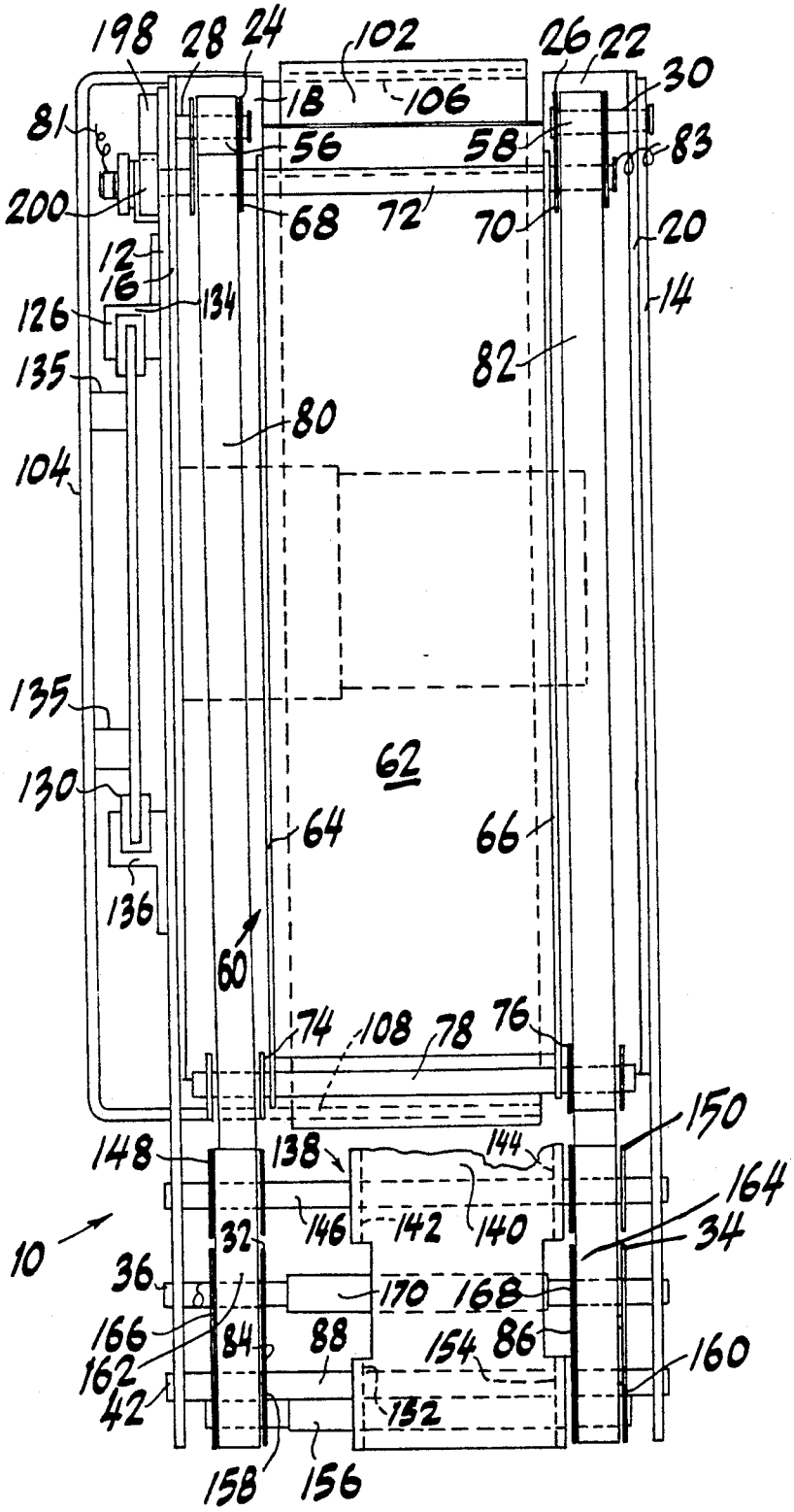
FIG. 2 is a rear elevation of the form of my multiple bill escrow apparatus illustrated in FIG. 1.

Referring now to the drawings, my multiple bill escrow apparatus indicated generally by the reference character 10 includes a frame having a left side plate 12 and a right side plate 14. Plate 12 carries a left side bill retaining angle having a flange 18. The right side plate carries a right hand bill retaining angle 20 having a flange 22.

I mount respective front belt upper feed rollers 24 and 26 on stub shafts 28 and 30 carried by side plates 12 and 14. Respective front belt lower turn rollers 32 and 34 are supported on a shaft 36 mounted in the side plates 12 and 14. I mount a pair of front belt return rollers 38 and 40 on a shaft 42 supported in the frame plates 12 and 14. A pair of front belt tension rollers 44 and 46 are carried by respective blocks, one block 48 of which is shown. Each of the blocks 48 is adjustably positioned in a slot 50 in the associated side plate 12 or 14 to permit the tension of the front belts to be adjusted.

The front belts 56 and 58 extend from the upper roller 24 and 26 downwardly to the turn rollers 32 and 34 and forwardly to the return rollers 38 and 40. From the rollers 38 and 40, the belts 56 and 58 extend rearwardly and around the respective belt tensioning rollers 44 and 46 back to the upper rollers 24 and 26.

My apparatus includes a floating belt subassembly indicated generally by the reference character 60 comprising a central backing plate 62 provided with flanges 64 and 66 extending along the vertical edges thereof. A shaft 72 supported by the flanges 64 and 66 adjacent to the upper ends thereof carries spaced floating belt upper rollers 68 and 70. A shaft 78 supported in the flanges 64 and 66 adjacent to the lower end thereof carries spaced lower floating belt rollers 74 and 76.

Respective floating belts 80 and 82 extend around the pairs of rollers 68 and 74 and 70 and 76. Four springs, three of which, 81, 83 and 85 are shown in the drawings urge the floating belt subassembly 60 toward a position at which belts 80 and 82 engage the rear vertical extents of belts 56 and 58.

I provide a return belt assembly for cooperating with the lower horizontal extents of the belts 56 and 58 for returning bills to the customer in a manner to be described hereinbelow.

Respective rear return belt rollers 84 and 86 are supported on a shaft 87. Respective return belt front rollers 88 and 90 are supported on a shaft 91. Rollers 84 and 88 receive return belt 92 while rollers 86 and 90 receive return belt 94. I provide the shafts 87 and 91 with resilient supports, two supports 95 and 97 of which are shown in the drawings for mounting these shafts on the plates 12 and 14. As will be explained more fully hereinbelow, this arrangement facilitates the handling of a plurality of bills stacked one on top of the other.

Upper and lower guide plates 96 and 98 carried by the side panels 12 and 14 lead to an output mouth 100 from which a customer can receive return bills in a manner to be described hereinafter.

A platform 101 extending between the side panels 12 and 14 forms the bottom of a bill receiving compartment indicated generally by the reference character 103 in which bills may be received on end from a bill acceptor (not shown).

My apparatus includes an arrangement for moving bills successively received in chamber 103 from the chamber to between the contiguous extents of belts 56 and 58 and 80 and 82 so that a plurality of bills may be held therebetween in an escrow position. A ram 102 is supported on the legs 106 and 108 of a U-shaped bracket, the leg 106 of which extends inwardly over the upper edge of panel 12 and the lower leg of which extends through a slot 110 in the panel 12.

A motor and gear box unit 112 supported on the outer surface of panel 12 has an output shaft 114 carrying a crank 116 for movement therewith. A pin 118 connects the crank 116 to a link 120. Another pin 122 connects the link 120 to a slide 124, the upper and lower edges of which are provided with pairs of bearing blocks 126 and 128 and 130 and 132 which ride in tracks 134 and 136 on the outer surface of the panel 12. Two pins 135 connect the slide 124 to the bracket 104.

From the structure just described, it will readily be appreciated that when motor 112 is energized, crank 116 drives link 120 to move slide 124 to move ram 102 from the full line position shown in FIG. 1 to the fragmentary broken line position indicated in dot dash lines in the Figure and back again. In the course of this movement, a bill in chamber 103 will be carried through the space between belts 56 and 58 and into engagement with the plate 62. In the course of this movement the entire subassembly 60 will be moved to the left as viewed in FIG. 1 against the action of springs 81, 83 and 85 until the bill has moved past the left vertical extent of the belts 56 and 58. When the subassembly 60 returns to its initial position the edges of the bill will be caught between the front vertical extents of belts 80 and 82 and the rear vertical extents of belts 56 and 58.

My apparatus includes means for selectively sending a stack of bills from the escrow position to the main stacker (not shown) or to the return mouth 100. A diverter assembly indicated generally by the reference character 138 comprises a bracket 140 having a first pair of legs 142 and 144 which receive a shaft 146 supported in the side panels 12 and 14 swingably to support the bracket 140 for movement around the axis of the shaft 146. This shaft 146 also supports a pair of diverter belt upper rollers 148 and 150.

A second pair of legs 152 and 154 on the bracket 140 support a shaft 156 carrying diverter belt lower rollers 158 and 160. The pair of rollers 148 and 158 carry a first diverter belt 162 which cooperates with the belt 56. The other pair of diverter belt rollers, 150 and 160, carry a second diverter belt 164 which cooperates with the belt 58.

A shaft 170 adjustably positioned in suitable slots in the panels 12 and 14 carries respective nip rollers 166 and 168 which cooperate with the rollers 32 and 34 to form nips through which the respective pairs of belts 56 and 162 and 58 and 164 pass.

A motor 172 has a shaft 174 carrying a crank 176. A pin 178 on the end of crank 176 rides in a slot 180 formed in an arm 182 of bracket 140. Motor 172 may be energized in a manner to be described to drive the crank 176 to cause pin 178 to move the bracket 140 to position rollers 158 and 160 in the dot dash line position shown in FIG. 1 at which the belts 158 and 160 direct bills coming from the escrow position toward the return mouth 100.

Shaft 174 also carries a cam 184 adapted to actuate a switch 186 to put out a signal indicating the present position of the diverter assembly 138.

Figure 3:
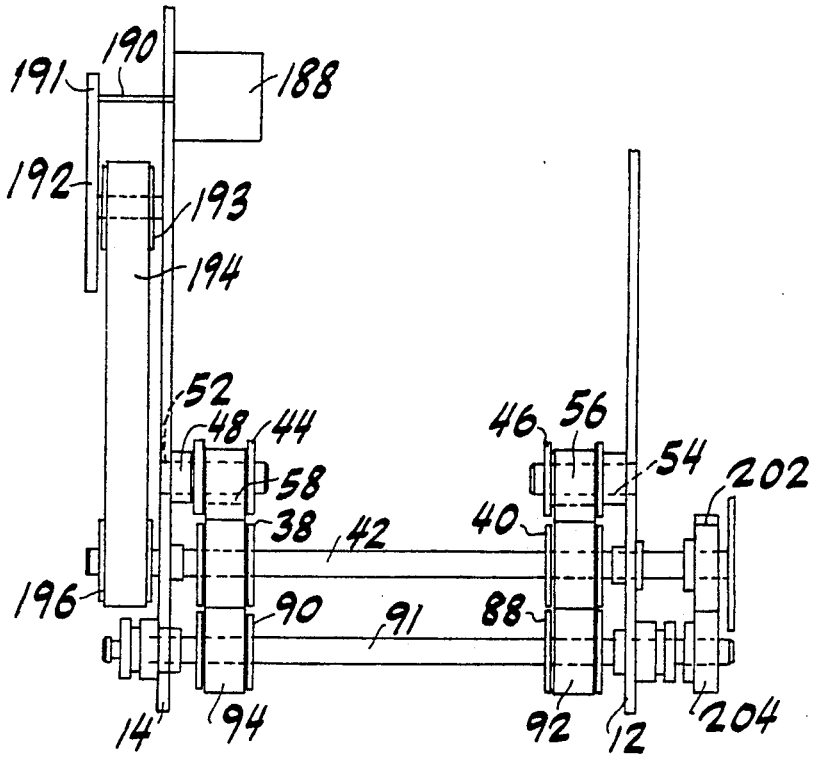
FIG. 3 is a fragmentary front elevation of the apparatus shown in FIG. 1 with parts removed.

Referring now to FIG. 3, a motor 188 is adapted to be energized to drive its shaft 190 carrying a pinion 191 which drives a reduction gear 192 and a pulley 193 which receives a belt 194 which extends around a pulley 196 carried by shaft 42 for rotation therewith. This arrangement provides the belt drive system of my multiple bill escrow arrangement.

Figure 4:
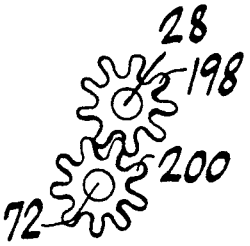
FIG. 4 is a fragmentary partially diagrammatic showing of a gear coupling employed in my multiple bill escrow apparatus.

A first pair of gears 198 and 200 provide a driving connection between the shaft 72 and the shaft 28. A second pair of gears 202 and 204 provide a driving connection between shafts 42 and 91. Referring now to FIG. 4, it will be seen that the gears 198 and 200 are so configured as to maintain the driving connection between shafts 28 and 72 even after these shafts are displaced in a direction perpendicular to their axes under the action of ram 102 as a bill is moved between the pairs of belts 56 and 58 and 80 and 82. I so configure these gears as to permit a buildup of around ten bills before the driving connection is lost. It will be appreciated, moreover, that as the floating belt assembly 60 is moved away from the position to which it is biased by springs 81, 83 and 85 under the action of the ram 102, the engagement between gears 198 and 200 will be entirely lost. Owing to the configuration of the teeth, however, this driving connection will be reestablished when the floating belt assembly 60 returns. I form the gears 202 and 204 in the same manner as gears 198 and 200 to permit the return belts 92 and 94 to move away from the horizontal extents of belts 56 and 58 when a stack of bills is being returned to the customer.

Figure 5:
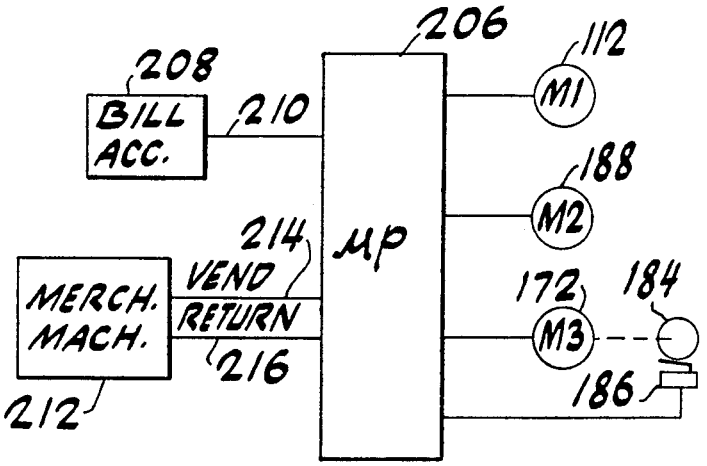
FIG. 5 is a block diagram of the control system which may be employed with my multiple bill escrow apparatus.

Referring now to FIG. 5, my multiple bill escrow mechanism may be associated with a control processor 206, a bill acceptor 208 adapted to put out an acceptable bill signal on a line 210, and a merchandising machine 212 adapted to provide a vend signal on a line 214 and a return signal on a line 216.

In operation of my multiple bill escrow apparatus, an acceptable bill is delivered by the acceptor 208 to the chamber 103. At the same time a signal on line 210 informs the microprocessor that the bill is indeed acceptable. In response thereto the microprocessor energizes motor 112 for one revolution to cause the ram 102 to reciprocate to carry the bill from chamber 103 through the space between belts 56 and 58 and into engagement with the floating assembly 60 or a previously accepted bill. The bill being carried from the chamber 103 is moved together with the floating frame 60 through a sufficient distance to move the edges of the bill beyond the left vertical extents of belts 56 and 58 so that when the ram returns the bill is trapped between the pairs of belts 56 and 58 and 80 and 82. In this manner all the bills which have been deposited before the customer makes a buy or requests return have moved into the space between the pairs of belts 56 and 58 and 80 and 82. Thus, the ram 102 and its operating mechanism just described constitute means for moving successively received bills from the chamber 103 into the escrow position between the pairs of belts 56 and 58 and 80 and 82.

Should the customer now make a purchase, the merchandising machine 212 will put out a vend signal on line 214 to the microprocessor 206. The processor in turn checks to see whether or not the diverter assembly 138 is in its full line position, illustrated in FIG. 1, in which the bills will be sent to the main stacker (not shown) or whether it is in its dot-dash line position. In the latter case motor 172 will be energized to return the diverter assembly 138 to its full line position.

Upon receiving a vend signal the control unit 206 also will energize motor 18 to drive the belt system. This drive train can be traced as follows. Motor 188 drives belt 194 to drive shaft 42. Since the shaft 42 is driven, both of the front belts 56 and 58 will be driven. As a result, shaft 28 carrying gear 198 is driven to drive gear 200 carried by the shaft 72 to drive both of the belts 80 and 82. In this wa the effective control over the stack of bills between the pairs of belts 56 and 58 and 80 and 82 is maintained.

Under the conditions just described, since the assembly 138 is in its full line position the stack of bills being delivered from the escrow position by the pairs of belts 56 and 58 and 80 and 82 will move straight downwardly, as viewed in FIG. 1, until they leave the escrow apparatus and are received by the main stacker (not shown).

In the event that a customer wishes to have his money returned before having made a selection, he actuates the appropriate push button or the like and the merchandising machine 212 puts out a return signal on line 216 leading to the central processor 206. When that has been done, the control 206 first ensures that the diverter assembly 138 already is in its return position or is moved to that position as indicated by the dot dash lines in FIG. 1. It will be remembered that the cam 184 operating on the switch 186 informs the processor 206 of the position of the diverter assembly. With the diverter assembly in its dot dash line or return position the belts 162 and 164 wrap around the pulleys 32 and 34 to such an extent as to direct the stack of notes into the space between the pair of belts 92 and 94 and the horizontal extents of belts 56 and 58.

Upon the occurrence of a return signal, controller 206 also energizes motor 188 in the manner described hereinabove so that shaft 42 is driven. In addition to the driving train described hereinabove, gears 202 and 204 provide a driving connection between shafts 42 and 91 so that both of the belts 92 and 94 also are driven. In this manner control of the pack of notes is maintained as they move toward the exit mouth 100. It will also be remembered that shafts 87 and 91 are so mounted as to permit some movement of the belts 92 and 94 away from the horizontal extents of belts 56 and 58 to accommodate the thickness of the stack. Further, gears 202 and 204 are so constructed as to maintain their driving connection even with the stack of notes in the space between belts 92 and 94 and the horizontal extents of belts 56 and 58.

It will be seen that I have accomplished the objects of my invention. I have provided a multiple bill escrow mechanism which is adapted to receive and to hold in an escrow position a plurality of bills. My mechanism may be selectively actuated to return the stack of bills to the customer or to deliver the stack to a main escrow. It maintains effective control over the stack of notes at all times. It is simple in construction and certain in operation for the result achieved thereby.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. Apparatus for receiving and temporarily holding a plurality of successively received bills in an escrow position and for delivering said bills together from said escrow position including in combination interengageable first and second conveyor means adapted to receive bills therebetween, means mounting said first and second interengageable conveyor means for movement toward and away from each other, resilient means for biasing said first and second conveyor means toward each other, means for moving successively received bills into an escrow position between said first and second conveyor means against the action of said resilient biasing means to build up a plurality of bills in said escrow position at which said bills are clamped between said conveyor means by said biasing means and means for concomitantly driving both of said first and second conveyor means to move said plurality of bills out of said escrow position as a unit.

2. Apparatus as in claim 1 including means for selectively diverting said plurality of bills being moved out of said escrow position to one of two separate paths.

3. Apparatus as in claim 2 including a third and fourth interengageable conveyor means disposed along one of said separate paths, means mounting the third and fourth conveyor means for movement toward and away from each other, means for biasing the third and fourth conveyor means toward each other and means for concomitantly driving the third and fourth conveyor means whereby a plurality of bills received thereby as a unit is moved along said one separate path as a unit.

4. Apparatus as in claim 3 in which one of said first and second conveyor means and one of said third and fourth conveyor means comprise a common belt.

5. Apparatus as in claim 4 in which said common belt comprises a first length extending from said escrow position along one of said separate paths and a second length extending from said first length along the other of said separate paths.

6. Apparatus as in claim 5 in which said diverting means comprises a belt having a first length in register with said first length of said common belt and a second length movable between a position at which it extends toward one separate path and a second position at which it is in register with said second length of said common belt.

7. Apparatus for forming a stack of a plurality of successively received bills and for conveying the stack from an escrow location to an output including in combination, a first belt length, a second belt length, means mounting said first and second belt lengths for relative movement toward and away from each other, resilient means for biasing said first and second belt lengths toward each other, means for moving successively received bills against the action of said resilient biasing means to an escrow position at which said bills are clamped between said belt lengths to form a stack of said bills in said escrow position between said belt lengths and means for concomitantly driving said belt lengths to move said stack as a unit from said escrow position to said output.

8. Apparatus as in claim 7 in which said drive means comprises a coupling providing a driving connection between said first and second belt lengths, said coupling being constructed and arranged to permit limited relative movement of said first and second belt lengths away from each other without losing said driving connection.

9. Apparatus as in claim 7 including a third belt length extending from said output at an angle to said first and second belt lengths, a fourth belt length in register with said third belt length, means mounting said third and fourth belt lengths for movement toward and away from each other to accommodate a stack of bills therebetween, means for concomitantly driving said third and fourth belt lengths to convey said stack as a unit and means for selectively diverting said stack from said output to said third and fourth belt lengths.

10. Multiple bill escrow apparatus for forming a stack from a plurality of successively received bills and for conveying the stack from a stack-forming location to an output including in combination a frame, a pair of spaced first belt lengths mounted on said frame, a floating support, a pair of spaced second belt lengths on said support, said second belt lengths having the same spacing as the first belt lengths and being in register therewith, resilient means on said frame for biasing said support to position said second belt lengths adjacent to said first belt lengths, a bill receiving chamber on said frame adjacent to said support, means for moving successively received bills from said chamber against the action of said resilient biasing means to an escrow position at which said bills are clamped between said first and second belt lengths to form a stack of bills in said escrow position and means for concomitantly driving said first and second belt lengths to move said stack from said escrow position to said output.

11. Apparatus as in claim 10 in which said means for concomitantly driving said first and second belt lengths comprises a coupling providing a driving connection between said first and second belt lengths, said coupling being constructed and arranged to permit limited movement of said first and second belt lengths away from each other without losing said driving connection.

12. Apparatus as in claim 11 in which said means for moving successively received bills comprises a ram, means mounting said ram on said frame for movement from a first position remote from said support through said chamber to carry a received bill through the space between said first belt lengths and into engagement with said support or with a previously received bill in engagement with said support to a second position at which said second belt lengths are displaced from said first belt lengths and means for reciprocating said ram between said positions whereby upon return of said ram to said first position said bill is captured between said first and second belt lengths.

13. Apparatus as in claim 12 in which said means for concomitantly driving said first and second belt lengths comprises a coupling providing a driving connection between said first and second belt lengths, said coupling being constructed and arranged to permit limited movement of said first and second belt lengths away from each other without losing said driving connection and to permit reestablishment of said driving connection upon return of said first and second belt lengths after such further relative movement away from each other as interrupts said driving connection.

14. A multiple bill escrow apparatus for receiving bills and for selectively directing a stack of received bills from an escrow position to an output or to a return path including in combination a first belt length extending in a direction toward said output, a second belt length extending in a direction toward said output to a first location beyond the end of said first belt length, a third belt length extending from said first location in a direction along said return path, a fourth belt length extending in the direction of said return path from a second location beyond said first location, means mounting said first and second belt lengths in register and for movement toward and away from each other to accommodate a stack of bills therebetween, means for moving a plurality of successively received bills to between said first and second belt lengths to form a stack of bills in an escrow position between said first and second belt lengths, means for concomitantly driving said first and second belt lengths to move said stack toward said first location, a fifth belt length having a first portion in register with said first belt length in advance of said first location and a second portion movable between a position at which it extends toward said output and a position at which it extends toward said second location to direct a stack of bills between said third and fourth belt lengths, means mounting said third and fourth belt lengths in register and for relative movement away from each other to accommodate a stack of bills therebetween and means for concomitantly driving said third and fourth belt lengths to move a stack along said return path.

15. Apparatus as in claim 14 in which said means for driving said first and second belt lengths comprises a coupling providing a driving connection between said first and second belt lengths, said coupling permitting limited relative movement between said first and second belt lengths without losing said driving connection.

16. Apparatus as in claim 15 in which said coupling comprises gears.

* * * * *